US005728916A

United States Patent [19]

Gough et al.

[11] Patent Number: 5,728,916

[45] Date of Patent: Mar. 17, 1998

[54] THERMAL CRACKING

[75] Inventors: Arthur Gough, Northallerton; Colin Ramshaw, Norley, both of United Kingdom

[73] Assignee: Imperial Chemical Industries PLC, London, England

[21] Appl. No.: 347,374

[22] PCT Filed: Apr. 30, 1993

[86] PCT No.: PCT/GB93/00920

§ 371 Date: Feb. 10, 1995

§ 102(e) Date: Feb. 10, 1995

[87] PCT Pub. No.: WO93/23498

PCT Pub. Date: Nov. 25, 1993

[30] Foreign Application Priority Data

May 19, 1992 [GB] United Kingdom ..... 9210655

[51] Int. Cl.[6] ..... C07C 4/04

[52] U.S. Cl. ..... 585/648; 585/649; 585/650; 585/921; 585/926

[58] Field of Search ..... 585/648, 650, 585/500, 900, 91, 913, 924, 926

[56] References Cited

U.S. PATENT DOCUMENTS

| | | | |
|---|---|---|---|
| 4,636,297 | 1/1987 | Uchiyama et al. | 208/48 AA |
| 5,160,501 | 11/1992 | Alagy et al. | 585/500 |
| 5,162,599 | 11/1992 | Mattuno et al. | 585/943 |
| 5,270,016 | 12/1993 | Alagy et al. | 585/913 |

FOREIGN PATENT DOCUMENTS 9015119 12/1990 WIPO .

OTHER PUBLICATIONS

Database WPI, Week 8304, Dec. 18, 1982, Derwent Publications Ltd., AN8308934K & JP,B,57 060 398.

*Primary Examiner*—Helane Myers

*Attorney, Agent, or Firm*—Cushman Darby & Cushman Intellectual Property Group of Pillsbury Madison & Sutro LLP

[57] ABSTRACT

Steam-free non-catalytic cracking of hydrocarbons in reaction zones each having surfaces heated externally and a heated surface to volume ratio above 3 $cm^{-1}$, at a rate such that the flow through each reaction zone is essentially laminar.

10 Claims, 1 Drawing Sheet

THERMAL CRACKING

BACKGROUND OF THE INVENTION

This application is a 371 of PCT/6893100920.

This invention relates to thermal cracking, and in particular to the thermal cracking of hydrocarbons. Hydrocarbons containing 2 or more carbon atoms, e.g. ethane, propane, butane, LPG, and naphtha are generally cracked to produce olefins by passing a mixture of the hydrocarbon and steam through tubes, free of internal packing, heated to a high temperature in a furnace in the absence of a catalyst. The cubes typically have an inside diameter of 25 to 100 mm or more and the feedstock/steam mixture passes through the tubes at a high flow rate so that the flow through the tubes is extremely turbulent so as to obtain good heat transfer. Typically the flow rate corresponds to a Reynolds No. of the order of 500,000 or more.

The presence of stem aids transfer of heat from the furnace walls to the hydrocarbon: the temperature of the tube walls in contact with the process stream is typically 100° C. or more above that of the gas. The steam also decreases the formation of coke and acts as a diluent to decrease the partial pressure (since the cracking reaction to olefins is favoured by low hydrocarbon partial pressures). Typically 0.3 to 0.5 tonnes of steam are employed per tonne of hydrocarbon feedstock and the outlet pressure is typically below 2.5 bar abs, for example in the range 1.7 to 2.1 bar abs.

However the use of steam is thermally inefficient and poses environmental problems. Thus steam is not completely inert under the conditions employed: normally the cracker effluent contains a small proportion of organic oxygenated compounds such as acetaldehyde, acetone, carboxylic acids, and phenols resulting from the reaction of steam with the hydrocarbon. After the cracking reaction, the effluent gas is cooled to condense the steam and as a result some of such compounds pass into the liquid water phase. While most of the water is recycled to form more steam, the presence of such compounds necessitates the addition of basic materials such as ammonia to the water to minimise corrosion. Also some of the water is bled off as a purge to avoid a build up of undesired components. This purge, typically amounting to about 10% of the condensed water, must be treated before disposal in order to avoid environmental problems.

The tubes of the cracker are normally made from steel containing a proportion of nickel in order to obtain the required mechanical properties at the temperatures encountered. Nickel, and to some extent some of the other components of the steel, catalyses the reaction of hydrocarbons with steam and also catalyses their decomposition to coke which adheres to the tube surfaces reducing heat transfer. To alleviate these problems, it is normal to introduce some sulphur compounds (which decrease the catalytic activity of nickel by acting as a catalyst poison) into the feedstock. However the sulphur compounds subsequently have to be removed from the effluent process gas: this is often effected by means of a scrubber wherein the process gas is contacted with an aqueous caustic solution. The disposal of the resultant caustic effluent also presents environmental problems.

SUMMARY OF THE INVENTION

We have found that these problems may be overcome by operating the cracking reaction in the substantial absence of stem. In order that the cracking reaction can be satisfactorily effected, various changes have to be made to the cracking process.

Accordingly we provide a process for the cracking of hydrocarbons comprising passing a hydrocarbon feedstock substantially free from steam through an externally heated catalyst-free reaction zone having a heated surface to volume ratio above 3 $cm^{-1}$ at a rate such that the flow through the reaction zone is essentially laminar.

DETAILED DESCRIPTION OF THE INVENTION

The process is operated in the substantial absence of steam, although we do not preclude the presence of small amounts of steam, e.g. up to 0.1 parts by weight of steam per part by weight of hydrocarbon feedstock. Preferably the reactants stream contains less than 0.05 parts by weight of steam per part by weight of hydrocarbon feedstock.

The reaction can be effected at similar hydrocarbon partial pressures to those conventionally employed. Optionally a diluent such as hydrogen or methane can be employed but it is possible, and often preferable, to crack the hydrocarbon feedstock in the absence of a diluent.

The reaction temperature is typically within the range conventionally used for hydrocarbon cracking: preferably the reaction zone is heated to a temperature in the range 700°–1100° C., particularly 700°–900° C.

In order that the cracking reaction can be effected efficiently, and to obtain good heat transfer, the reaction is effected with the gas passing in essentially laminar fashion through a reaction zone having a high heated surface to volume ratio. With a tubular reactor, i.e. where the cracking is effected in tubes, the surface to volume ratio is 4/d where d is the internal diameter of the tube. As mentioned above, cracking is conventionally effected in tubes of internal diameter ranging from 25–100 mm: in such tubes the surface to volume ratio is in the range 0.4–1.6 $cm^{-1}$. In the present invention the surface to volume ratio employed is much higher, e.g. above 3 $cm^{-1}$, and preferably in the range 4–20 $cm^{-1}$. As a result of the increased surface to volume ratio, the temperature difference between the reactor surface and the gas passing therethrough is decreased. Also the flow rate is such that the flow is essentially laminar, i.e. having a Reynolds No. below about 3000.

Because of the small proportion, or absence, of steam, it is important to minimise coke formation: since coke formation is catalysed by nickel and other metals, the reactor surfaces exposed to the gas undergoing cracking are preferably inert, i.e. exhibit essentially no catalytic activity for the reactions of hydrocarbons, at the reaction temperature. This may be achieved by constructing the reactor from a catalytically inert material such as silica or silicon carbide, or from metals such as copper that exhibit no catalytic activity under the conditions employed, or by providing a non-porous coating of such materials on a suitable constructional material such as steel. Heretofore coatings of an inert material such as silica have not been very successful because of the abrasive effect of turbulent gas streams and the appreciable volatility of silica in steam at high temperatures. The laminar flow, and the absence of steam, in the present invention renders such coatings feasible. Alternatively a coking inhibitor may be added to the reactants stream fed to the reactor. In the absence of steam such coking inhibitors may be more effectively retained on the reactor surfaces.

In the present invention, the reactor has surfaces that are heated externally, i.e. by a heating medium passing through a heating zone adjacent to the reaction zone and separated from the reaction zone by a relatively thin wall. The heating medium may be the product of combustion of a suitable fuel.

Alternatively the heating zone may have a coating of a combustion catalyst on its surfaces and a fuel/air mixture is passed through the heating zone so that at least part of the heat is produced by combustion occurring in the heating zone. Alternatively the heating medium may be hot helium from a nuclear reactor cooling system.

In order to obtain a useful throughput, there are preferably a plurality of reaction zones in parallel. For example the reactor may be of honeycomb configuration so that the honeycomb passages are alternately reaction zones and heating zones through which a heating medium is passed.

Alternatively, and preferably, the reactor is in the form of an assembly, e.g. stack, of parallel plates. The hydrocarbon feedstock and heating medium are respectively passed through the alternate spaces between the plates. Thus the hydrocarbon feedstock is passed between one pair of plates while the heating medium is passed through the space on either side of that pair of plates. Thus using as a heating zone plates bearing a combustion catalyst, the plates have a combustion catalyst on one side and are disposed with the catalyst coated surfaces facing one another: a fuel/air mixture is passed through the spaces between the opposed catalyst coated surfaces so that at least part of the heat is produced by catalytic combustion which takes place at those surfaces and the heat is transferred through the plates to the hydrocarbon feedstock passing between the spaces between the surfaces of the plates that are free from combustion catalyst. Where plates bearing a combustion catalyst are employed, it may be preferable to apply the catalyst coating to the appropriate surfaces after forming an assembly of the plates.

To obtain a high heated surface to volume ratio for the region wherein the cracking reaction is to occur, in such a plate-configuration reactor, the plates defining the region through which the hydrocarbon feedstock is passed are preferably spaced apart by 1–5 mm. Such spacing gives a surface to volume ratio of approximately 4–20 $cm^{-1}$. The spacing between plates defining the spaces through which the heating medium passes may be of similar magnitude but is not necessarily the same as the spacing of the plates through which the hydrocarbon feedstock passes.

The heating medium my flow co-currently, counter-currently, or transversely to the flow of hydrocarbon feedstock. However the heat requirements for the cracking reaction make co-current flow preferable. Although construction may be facilitated, flow of the heating medium in a direction transverse to that of the hydrocarbon feedstock may present problems since one side of the reactor assembly will tend to be much hotter than the other.

BRIEF DESCRIPTION OF THE DRAWINGS

One form of construction of a plate reactor for use in the invention is shown in the accompanying drawings wherein.

Referring to the Figures, the reactor is assembled from a plurality of rectangular plates 10, each having its corners cut away, and spacers 11 between adjacent plates. Each spacer has two limbs 12, 13 corresponding to the length and width respectively of the plates up to the cut away corners and has an integral member 14 connecting the two limbs 12, 13. Two spacers 11*a*, 11*b* are associated with each plate and disposed so that one spacer 11*a* extends along two adjacent edges of the plate and across the included cut away corner while the other spacer 11*b* extends along the opposite edges of the plate and extends across the opposite corner. Thus each plate with its pair of spacers forms a tray-like structure with gaps at one pair of opposed corners. The spacers associated with the next adjacent plate are disposed such that gaps occur at the other pair of opposed corners of the plate. Conduit means, not shown, are attached to the corners of the assembly to permit flow of reactants diagonally across the tray-like structure of one plate from a reactants inlet duct at one corner to a product outlet duct at the diagonally opposed corner, and heating medium to flow diagonally across the tray-like structures of the adjacent plates above and below that one plate from a heating medium inlet duct at another corner of the assembly to a heating medium outlet duct at the diagonally opposed corner.

Figure 1:
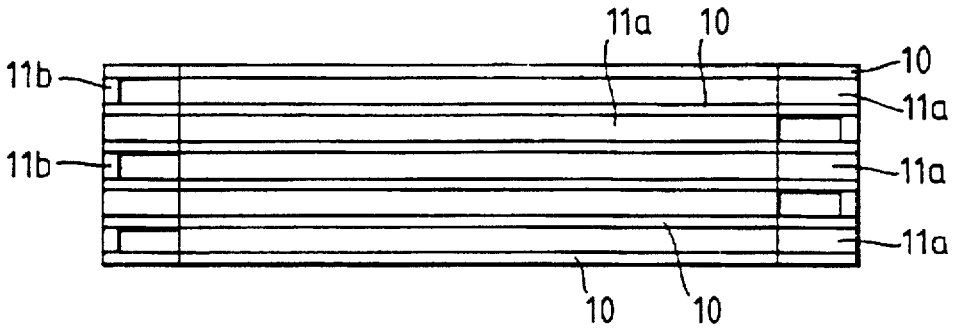
FIG. 1 is an elevation of an assembly of plates and spacers.
Figure 2A:
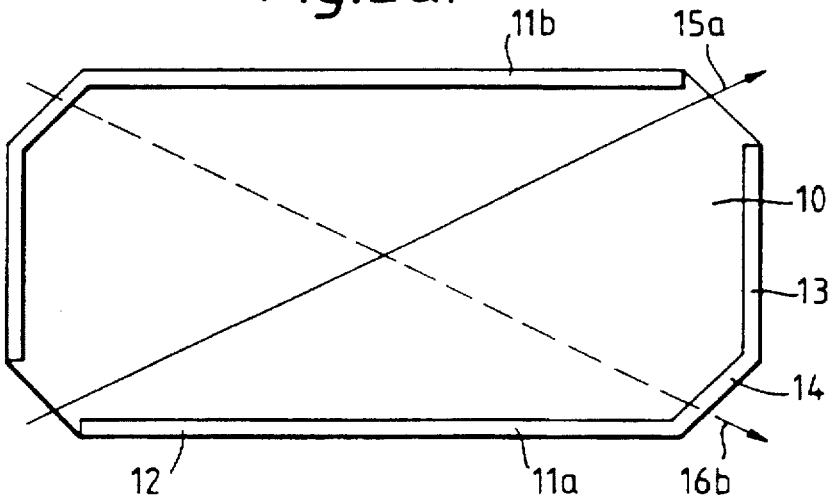
FIG. 2*a* is a plan of one plate and its associated spacers.
Figure 2B:
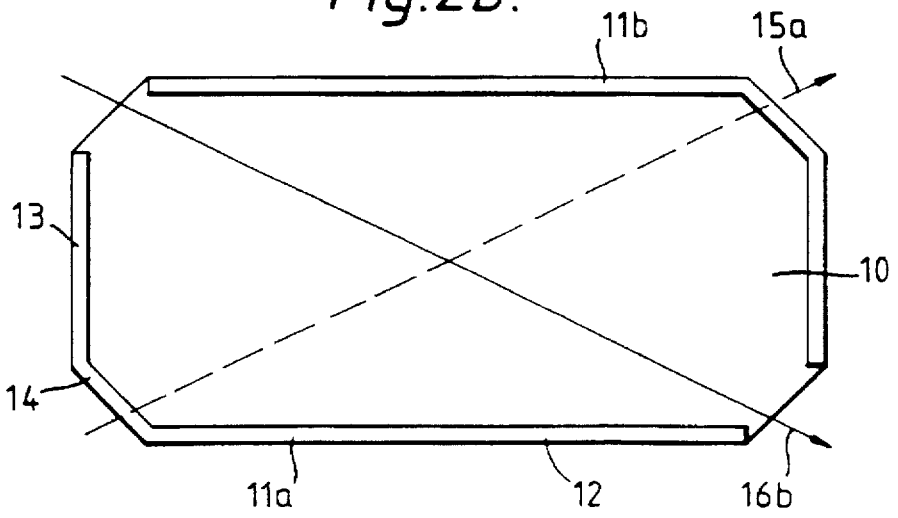
FIG. 2*b* is a plan of the plate, and its spacers, that is next adjacent to the plate and spacer of FIG. 2*a*.

It is preferred that the plates, and hence reaction and heating zones, are of an elongated rectangular configuration, rather than square, with the inlets and outlets for the reactant stream and heating medium positioned at diagonally opposed corners of their respective zones, and the inlets are at adjacent corners of one of the shorter rectangle sides. Thus the inlet ducts are both at adjacent corners of the shorter edges of the rectangles: thus as shown in FIG. 2*a*, the heating medium flows in the direction of the arrow 15*a* while the reactants stream flows generally co-currently in the direction of dotted arrow 16*b* on the other side of the plate. Likewise, referring to FIG. 2*b*, the reactants stream flows in the direction of arrow 16*b* while the heating medium flows in the direction of the dotted arrow 15*a* on the other side of the plate.

The individual plates and spacers do not necessarily have to be welded or fused together. Thus the assembly may be clamped together together with the inlet and outlet ducts and enclosed in a vessel to which a suitable gas, such as methane, is charged at a pressure slightly above the reaction pressure. The pressurising gas will pass through any leakage paths into the relevant reaction or heating zone and hence become part of the reactants in that zone. Coke deposition will gradually occur in such leakage paths, thereby minimising such leakage.

Although sulphur in the feedstock is not deleterious to the reaction, the feedstock is preferably free from sulphur or compounds thereof: in this way a subsequent scrubbing operation to remove sulphur is unnecessary. For this reason it is preferred to employ feedstocks such as ethane, propane, butane, LPG or raffinates from the production of aromatics. Naphtha feedstocks generally contain a significant amount of sulphur but may be employed if a desulphurisation step is included. The feedstock contains saturated hydrocarbons containing 2 or more carbon atoms, but may also contain a proportion of unsaturated hydrocarbons. The feedstock may also contain hydrogen and/or methane as a diluent.

It will be appreciated that some coke formation is liable to occur as in conventional cracking. The coke can be removed as in conventional practice by techniques such as steam de-coking at higher temperatures or burning off with an oxygen containing gas. The latter method is preferred where the reaction zones have coatings of a material such as silica exhibiting appreciable volatility in steam.

The present invention provides several advantages. Not only are the aforementioned environmental problems overcome, but also the avoidance of process steam enables capital savings to be made: also the avoidance of a caustic scrubber, where sulphur-free feeds are employed, gives further capital savings. Also energy savings are achieved by the avoidance of the need to raise process steam.

The invention is illustrated by the following examples. For each of the examples a silica tube 2 m long and 2 mm internal diameter was employed. The surface to volume ratio was thus about 20 $cm^{-1}$. It was heated in a furnace with a substantially uniform temperature profile. The feedstocks, which were all steam and sulphur free, were not preheated. The pressure at the exit of the reactor was 1.4 bar abs and the pressure drop across the reactor was less than 0.05 bar. The flow rate was such that the Reynolds No. was about 500.

EXAMPLE 1

The furnace temperature was set at 890° C. and an ethane flow of 84 g/h was passed through the tube for 2 hours. The product was quenched rapidly and analysed at various intervals during the experiment. A typical analysis of the product is set out in the Table below. After 2 hours the run was terminated and deposited coke burnt off in air and the carbon dioxide evolved was measured. This showed that 15 mg of coke had been deposited during the two hours duration of the reaction. Extrapolation shows that the reactor could remain on line for 8 days at these conditions before the cross section of the tube had been decreased by 10% due to coke formation.

EXAMPLE 2

Example 1 was repeated using a propane feed at a rate of 79 g/h and a furnace temperature of 875° C. As in Example 1 the amount of coke deposited in 2 hours was 15 mg of coke.

EXAMPLE 3

Example 1 was repeated using a furnace temperature of 840° C. and a feed of 81 g/h of a liquid hydrocarbon feedstock of average molecular weight 94 and of approximate weight composition:

| | |
|---|---|
| n-paraffins | 22% |
| i-paraffins | 67% |
| cyclo-paraffins | 4% |
| aromatics | 7% |

The reaction was stopped after 1 hour and then the amount of coke deposited determined as in Example 1. This showed that 12 mg of coke had been deposited during the one hour duration of the reaction. Extrapolation shows that the reactor could remain on line for about 3½% days at these conditions before the cross section of the tube had been decreased by 10% due to coke formation.

Table

| | Product composition (weight %) | | |
|---|---|---|---|
| | Example 1 | Example 2 | Example 3 |
| hydrogen | 3.84 | 1.41 | 0.83 |
| methane | 3.98 | 19.76 | 15.07 |

Table-continued

| | Product composition (weight %) | | |
|---|---|---|---|
| | Example 1 | Example 2 | Example 3 |
| ethene | 53.30 | 33.55 | 25.53 |
| ethane | 33.97 | 2.34 | 4.26 |
| propene | 1.07 | 17.25 | 17.32 |
| propane | 0.14 | 18.09 | 0.68 |
| butadiene | 1.80 | 2.42 | 4.41 |
| other C4 compounds | 0.45 | 1.56 | 8.30 |
| benzene | 0.35 | 0.86 | 3.10 |
| fuel oil | 1.10 | 2.76 | 3.93 |
| others | 0.00 | 0.00 | 16.52 |

We claim:

1. A process for the cracking of hydrocarbons comprising passing a feedstock containing saturated hydrocarbons containing 2 or more carbon atoms and that is substantially free from steam through a catalyst-free reaction zone externally heated to a temperature in the range 700° to 1100° C. and having a heated surface to volume ratio above 3 $cm^{-1}$ at a rate such that the flow through the reaction zone is laminar having a Reynolds No. below 3000.

2. A process as claimed in claim 1 wherein the reactant stream passed through the reaction zone contains hydrogen or methane as a diluent.

3. A process as claimed in claim 1 the surfaces of the reaction zone exposed to the gas undergoing cracking exhibit essentially no catalytic activity for the reactions of hydrocarbons at the reaction temperature.

4. A process as claimed in claim 3 wherein the surfaces of the reaction zone exposed to the gas undergoing cracking are constructed from, or have a non-porous coating, of silica, silicon carbide, or copper.

5. A process as claimed in claim 1 wherein the reaction zone is heated by passing a heating medium through a heating zone separated from the reaction zone by a thin wall.

6. A process as claimed in claim 5 wherein the heating zone has a coating of a combustion catalyst on its surfaces and a fuel/air mixture is passed through the heating zone so that at least part of the heat is produced by combustion occurring in the heating zone.

7. A process as claimed in claim 1 wherein a plurality of reaction zones are provided in parallel.

8. A process as claimed in claim 7 wherein reaction and heating zones are alternately provided by the spaces between adjacent plates of an assembly of parallel plates separated by spacers.

9. A process as claimed in claim 8 wherein the plates, and hence reaction and heating zones, are of an elongated rectangular configuration, with the inlets and outlets for the reactant stream and heating medium positioned at diagonally opposed corners of their respective zones, and the inlets are at adjacent corners of one of the shorter rectangle sides.

10. A process as claimed in claim 8 wherein the assembly is clamped together together with inlet and outlet ducts and enclosed in a vessel to which a gas is charged at a pressure above the reaction pressure.

* * * * *